US008382054B2

(12) United States Patent
Hsu et al.

(10) Patent No.: US 8,382,054 B2
(45) Date of Patent: Feb. 26, 2013

(54) HOLDING DEVICE FOR APPARATUS HAVING THE SAME

(75) Inventors: Ming Chang Hsu, Hsinchu (TW); Ming Hsin Chuang, New Taipei (TW); Mon Wen Yang, Hsinchu (TW); Thomas Y. S. Shen, Hsinchu (TW)

(73) Assignee: Apex Biotechnology Corp., Hsinchu (TW)

( * ) Notice: Subject to any disclaimer, the term of this patent is extended or adjusted under 35 U.S.C. 154(b) by 0 days.

(21) Appl. No.: 13/090,455

(22) Filed: Apr. 20, 2011

(65) Prior Publication Data

US 2012/0126082 A1 May 24, 2012

(30) Foreign Application Priority Data

Nov. 22, 2010 (TW) ..... 99222599 U

(51) Int. Cl.
*A47G 1/10* (2006.01)

(52) U.S. Cl. ..... 248/316.4

(58) Field of Classification Search ..... 248/316.4, 248/316.2, 229.12, 229.22, 231.41, 689, 248/223.31, 229.11, 229.21; 24/523
See application file for complete search history.

(56) References Cited

U.S. PATENT DOCUMENTS

| | | | | |
|---|---|---|---|---|
| 5,690,311 | A | 11/1997 | Leighton et al. | |
| 5,836,563 | A * | 11/1998 | Hsin-Yung | 248/316.4 |
| 5,947,359 | A * | 9/1999 | Yoshie | 224/570 |
| 6,370,741 | B1 * | 4/2002 | Lu | 24/523 |
| 7,401,755 | B2 * | 7/2008 | Wu | 248/346.07 |
| 2008/0124243 | A1 | 5/2008 | Chen | |

FOREIGN PATENT DOCUMENTS

| | | |
|---|---|---|
| EP | 1118856 A1 | 7/2001 |
| TW | M368068 | 11/2009 |
| WO | 2006103440 | 10/2006 |

OTHER PUBLICATIONS

Search report issued on Feb. 16, 2012 from European counterpart application 11 16 4555.

* cited by examiner

*Primary Examiner* — Ramon Ramirez
(74) *Attorney, Agent, or Firm* — WPAT, P.C.; Anthony King

(57) ABSTRACT

A holding device comprises a first accommodation portion, a second accommodation portion, an elastic portion, and an actuating portion. The elastic portion includes a first end contacting the first accommodation portion and a second end contacting the actuating portion. The first accommodation portion includes at least one aperture. The second accommodation portion includes at least one connecting part, which passes through the aperture and connects with the actuating portion. When the actuating portion is pressed toward the first accommodation portion, a space between the first accommodation portion and the second accommodation portion expands.

18 Claims, 7 Drawing Sheets

50

HOLDING DEVICE FOR APPARATUS HAVING THE SAME

TECHNICAL FIELD

The present invention relates to a holding device. Particularly, the present invention relates to a holding device for accommodating a testing strip. More particularly, the present invention relates to a holding device which has simple structure and low cost, and which does not require removal of the testing strip by hand after testing.

BACKGROUND

As the global population ages and includes more elderly people, nurses will be in increasingly short supply. Thus, the medical device industry will focus research efforts on finding ways to reduce misdiagnosis, improving patients' condition after treatment, and enhancing home care services. In addition, with the aging of the global population, the number of patients is increasing dramatically. In particular, the number of patients with metabolic diseases is growing especially quickly and estimated to over 1.1 billions in 2012. Therefore, hospitals will have greater need for Point-of-Care Testing (POCT) systems. The demand for such POCT systems is estimated to be increasing at an annual rate of 14.1%.

One type of POCT system is the low-invasion biochemical testing system. This system requires only a small amount of blood for testing and is therefore preferred by patients over other testing systems. However, although the biochemical testing system requires only small amounts of blood, the testing strip still contains a quantity of blood sample after testing. Therefore, there still remains the risk of infection to medical caregivers, especially when such personnel must remove the testing strip by hand.

Taiwanese Patent M368068 discloses a holding device for testing strips that is capable of ejecting the testing strips. FIG. 1 shows a traditional holding device 10 for testing strips comprising an accommodation body 110, an ejection body 150, an L-shaped fixation member 120, a sensing terminal 130, and a spring 140. The holding device 10 utilizes a number of designs such as allowing the spring 140 to surround the rod 153, embedding the spring 140 into the guiding groove 118, aligning the first blocker 115 and the second blocker 155, and engaging the fixation member 120 with the groove 114 to stabilize the elastic force for ejecting the testing strip. Although the traditional holding device provides equal elastic force to prevent the holding device 10 from coming apart and to control the ejecting direction of the testing strip, the accommodation body 110 must be driven in parallel to the testing strip which constrains the ejecting distance and direction of the testing strip. In addition, the structure of the holding device 10 is too complicated to easily reduce cost or to control the ejecting force of the testing strip.

Therefore, it is necessary to provide a lower-cost holding device having a simple structure and a user-friendly operation.

SUMMARY

Based on the defects of the prior art, the objective of the present invention is to provide a testing strip holding device that does not require manual contact with the testing strip after the testing is completed. The holding device of the present invention can moderate the ejecting force applied on the testing strip, solves the problem of the prior art in which the testing strip could be easily stuck on the mechanism, and provides several additional advantages over the prior art, such as a simple and solid structure, equal elastic ejection force, and low cost.

A purpose of the present invention is to provide a holding device for an apparatus that overcomes the above-mentioned defects of the prior art. The holding device comprises a first accommodation portion, a second accommodation portion, an elastic portion, and an actuating portion. The elastic portion includes a first end contacting the first accommodation portion and a second end contacting with the actuating portion. The first accommodation portion includes at least one aperture. The second accommodation portion includes at least one connecting part, passing through the aperture and connecting with the actuating portion. When the actuating portion is pressed toward the first accommodation portion, a space between the first accommodation portion and the second accommodation portion expands.

The holding device according to another objective of the present invention comprises a first accommodation portion, a second accommodation portion, an elastic portion and an actuating portion. The elastic portion includes a first end applying force to the first accommodation portion and a second end applying force to the actuating portion. The second accommodation portion includes at least one connecting part. The first accommodation portion includes at least one aperture, through which the connecting part passes in order to connect with the actuating portion. When the actuating portion is located at an initial position, the elastic portion forces the first accommodation portion to contact the second accommodation portion, and a space is formed between the first accommodation portion and the second accommodation portion.

Other purposes of the present invention are disclosed by the following description, easily anticipated from the present specification, and taught in the detailed description of the present application. All described components of the present invention can be realized by the components and assembly thereof indicated in the claims. It should be noted that the above-mentioned description and the detailed description that follows indicate, but are not limited to, the embodiment of the present invention.

The foregoing has outlined rather broadly the features and technical benefits of the present invention in order that the detailed description of the invention that follows may be better understood. Additional features and benefits of the invention will be described hereinafter, and form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The accompanying drawings, which are incorporated in and constitute a part of this specification, illustrate embodiments of the present invention and, together with the description, serve to explain the principles of the invention.

DETAILED DESCRIPTION

The present invention discloses a holding device with simple structure and low cost. Such holding device allows users to remove the testing strip without contacting the testing strip by hand such that ex vitro diagnosis is more convenient, safer, and free from the risk of infection. Hereinafter, embodiments of the present invention will be described in detail with reference to the attached drawings.

Figure 1:
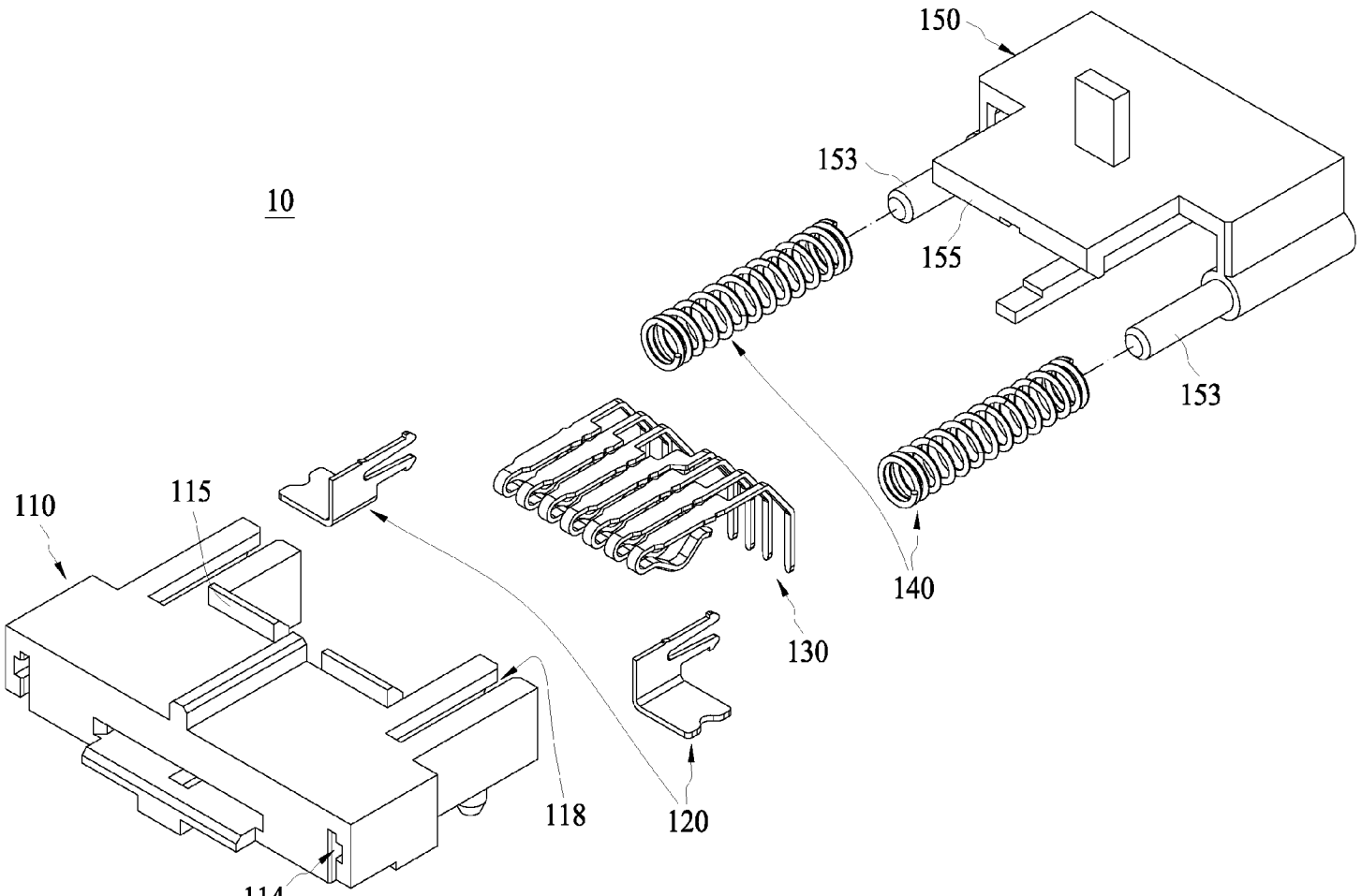
FIG. 1 (PRIOR ART)
FIG. 1 shows an exploded perspective view of a conventional holding device.
Figure 2:
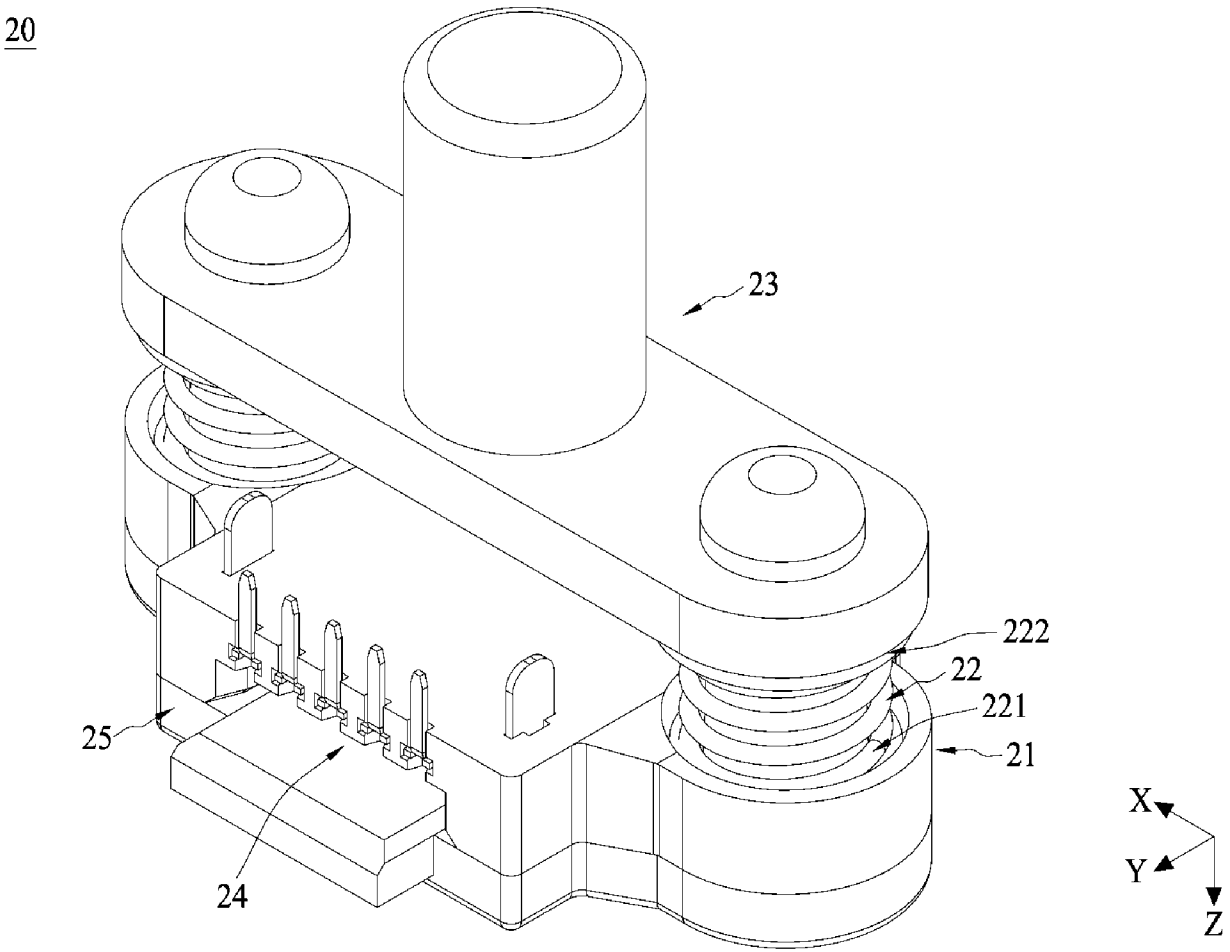
FIG. 2 is a perspective view showing a holding device according to one embodiment of the present invention.
Figure 3:
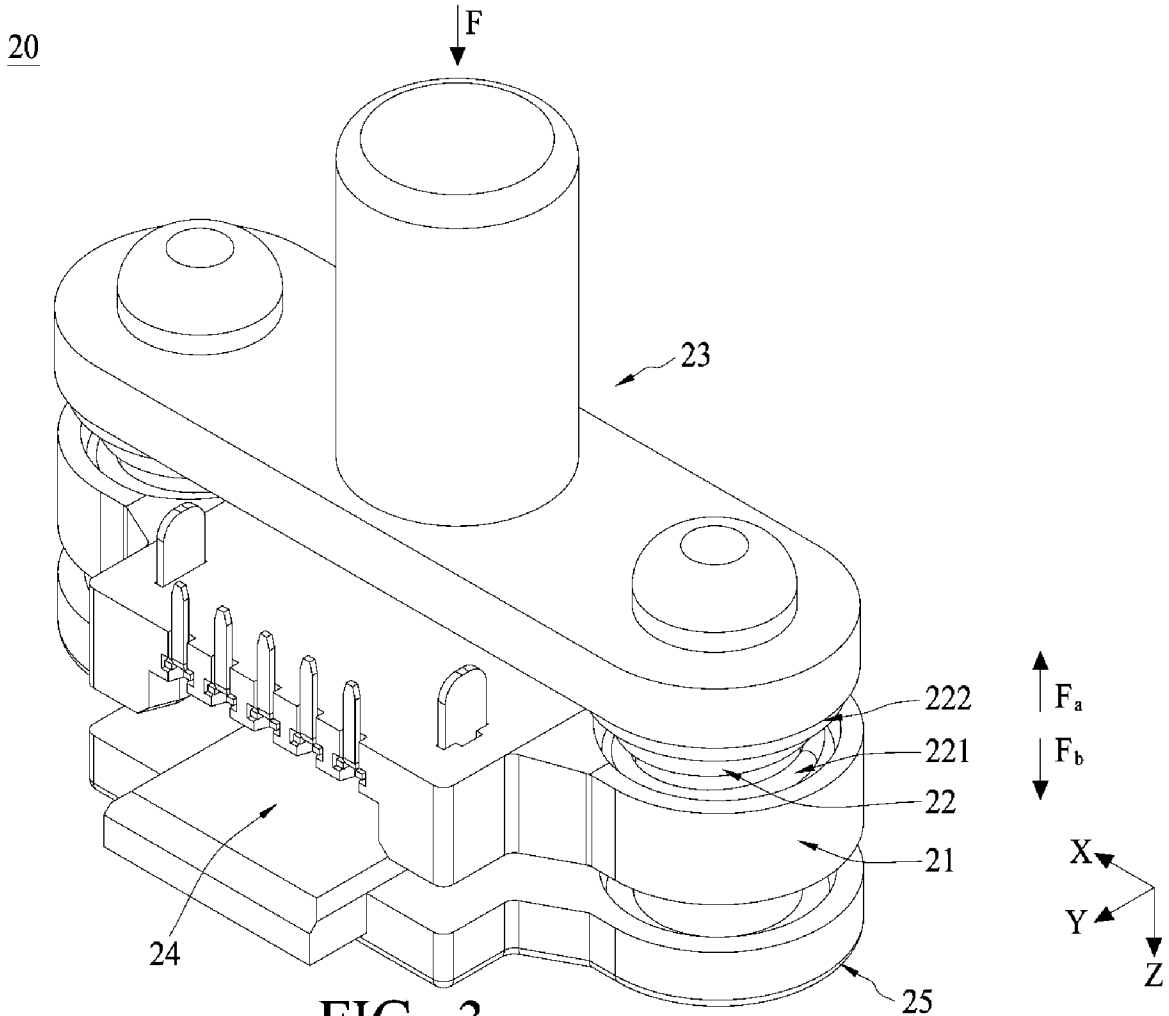
FIG. 3 is a perspective view showing a pressed holding device according to one embodiment of the present invention.

In one embodiment, as shown in FIG. 2 and FIG. 3, the present invention provides a simple-structure holding device 20 with low cost. The holding device 20 includes a first accommodation body 21, a second accommodation body 25, an elastic portion 22 and an actuating portion 23. The elastic portion 22 includes a first end 221 and a second end 222. In this embodiment, the actuating portion 23 and the second accommodation body 25 can be independent parts assembled together, or they can be a single integrated piece. The first end 221 of the elastic portion 22 contacts the first accommodation portion 21, while the second end 222 of the elastic portion 22 contacts the actuating portion 23. As shown in FIG. 3, when force F is applied to the actuating portion 23 and the first accommodation portion 21 is fixed in an apparatus (not shown), the actuating portion 23 and the second accommodation portion 25 will be pressed down together. Consequently, the elastic portion 22 is compressed to generate force $F_a$ and force $F_b$, which are applied to the actuating portion 23 and the first accommodation portion 21, respectively. When the force F is stronger than the force $F_a$ applied to the elastic portion 22, a space 24 between the first accommodation portion 21 and the second accommodation portion 25 will expand in the Z-axis direction for inserting or ejecting the testing strip (not shown).

In the embodiment shown in FIG. 2 and FIG. 3, the first accommodation portion 21 can contact the second accommodation portion 25, or the second accommodation portion 25 can move away from the first accommodation portion 21 to form a space 24. The relative movement between the first accommodation portion 21 and the second accommodation portion 25 is in the Z-axis direction. As shown in FIG. 2, without any force F, the first end 221 is applied force to the first accommodation portion 21, while the second end 222 is applied force to the actuating portion 23. Thus, the elastic portion 22 causes the first accommodation portion 21 to contact the second accommodation portion 25 to form a minimized space 24.

Figure 4:
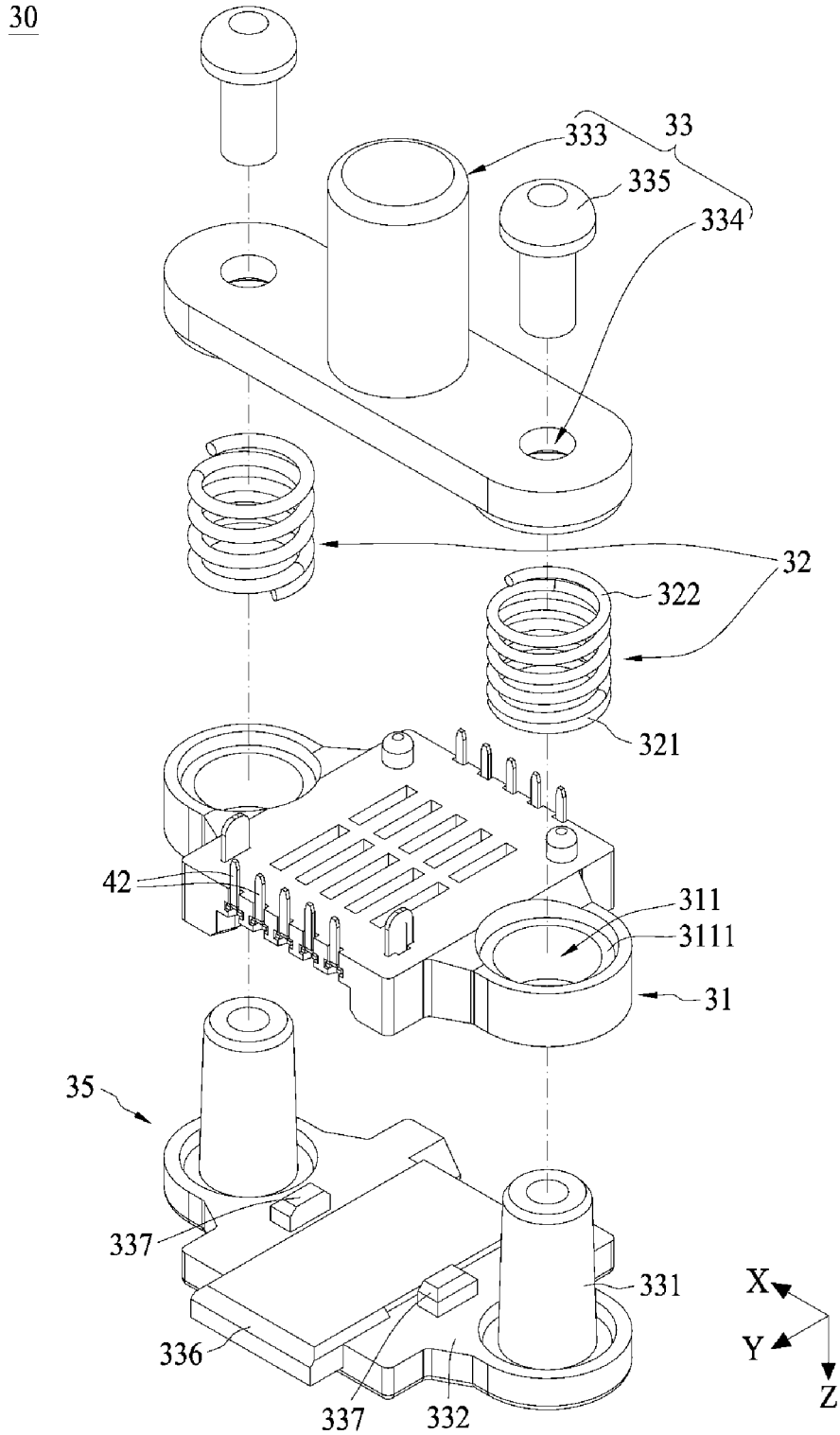
FIG. 4 is an exploded perspective view showing a holding device according to another embodiment of the present invention.

FIG. 4 shows an exploded perspective view of another embodiment of the present invention and discloses a holding device 30 for an apparatus (not shown). The holding device 30 includes a first accommodation portion 31, a second accommodation portion 35, an elastic portion 32, and an actuating portion 33. The first accommodation portion 31 includes two apertures 311. The second accommodation portion 35 includes two connecting parts 331 and a base 332. The two connecting parts 331 are oppositely disposed on the base 332. However, in other embodiments (not shown), according to different designs or requirements, the connecting parts 331 could be disposed at or near the center of the base 332. Accordingly, the first accommodation portion 31 can include an aperture 311 in relation to the central connecting part 331. Moreover, the shape of the connecting part 331 is selected from the group consisting of, but not limited to, cylinder, cone, polygonal column, polygonal cone, and other shapes providing the same function. Since the connecting part 331 passes through the aperture 311, the shape of aperture 311 is preferably corresponding to the shape of the connecting part 331. However, in another embodiment (not shown), the shape of the aperture 331 could be modified according to different designs which are not necessarily related to the shape of the connecting part 331. In the present embodiment, since the base 332 can move closer to or away from the first accommodation portion 31, a space 24 (as shown in FIG. 2) is formed when the base 332 contacts the first accommodation portion 31.

In the embodiment shown in FIG. 4, the outline of the aperture 311 is formed as a depressed surface 3111. The depressed surface 3111 can accommodate the first end 321 of the elastic portion 32. However, in another embodiment (not shown), the first end 321 can directly or indirectly apply force to the depressed surface 3111. In this embodiment, the elastic portion 32 includes two springs, but in other embodiments (not shown) the elastic portion may include only a single spring. The elastic portion 32 is selected from the group consisting of, but not limited, to compression spring, constant force spring, torsion spring and other components capable of providing similar elastic force. In this embodiment, the elastic portion 32 surrounds the connecting part 331. The elastic portion 32 may or may not contact the outline of the connecting part 331.

In the embodiment shown in FIG. 4, the actuating portion 33 further includes a button 333, two holes 334 oppositely disposed on the actuating portion 33, and two fixing parts 335 for connecting the actuating portion 33 to the connecting part 331. In particular, the holes 334 are disposed on two sides of the button 333. In the present embodiment, the number of holes 334 and fixing parts 335 is two, but in another embodiment (not shown), the number of holes 334 and fixing parts 335 could be one. The fixing part 335 is selected from the group consisting of, but not limited to, screw, tenon, solder, epoxy composition, and other components providing the similar function. In this embodiment, the connecting part 331 has a hollow axle in relation to the hole 334 such that the fixing part 335 passes through the hole 334 and secures in the hollow axle to axially connect with connecting part 331. The connecting part 331 and the hole 334 are connected in the same axis. The height of the connecting part 331 ranges from 0.05 μm to 5 μm. The height of the connecting part 331 provides a space for the elastic portion 32 being compressed. When the holding device 30 shown in FIG. 4 is assembled, the holding device 30 appears the same as the holding device 20 shown in FIG. 2.

In the embodiment shown in FIG. 4, the actuating portion 33 further includes a button 333, which preferably is, but is not limited to, a cylinder or other structure capable of being pressed. Since the button 333 is one part of the actuating portion 33, when the button 333 is pressed by force F as shown in FIG. 3, the actuating portion 33 will shift down and through the connecting part 331 to drive the second accommodation portion 35 down so as to expand the space 24 in the Z-axis direction.

In the embodiment shown in FIG. 4, the second accommodation 35 further includes a supporting platform 336 and at least a guiding part 337. The supporting platform 336 is disposed on the base 332 and is capable of holding the testing strips (not shown). The testing strip is disclosed in specification of U.S. Publication No. 20100206728. The guiding part 337 is disposed on the base 332 and on one or two sides of the platform 336 for guiding the testing strip to be inserted or ejected. In addition, FIG. 4 shows that the sensing terminal 42 is disposed inside of the first accommodation portion 31. Particularly, the sensing terminal 42 is disposed in the first accommodation portion 31 in relation to the base 332 for sensing the electrochemical reaction in the space 34.

Figure 5:
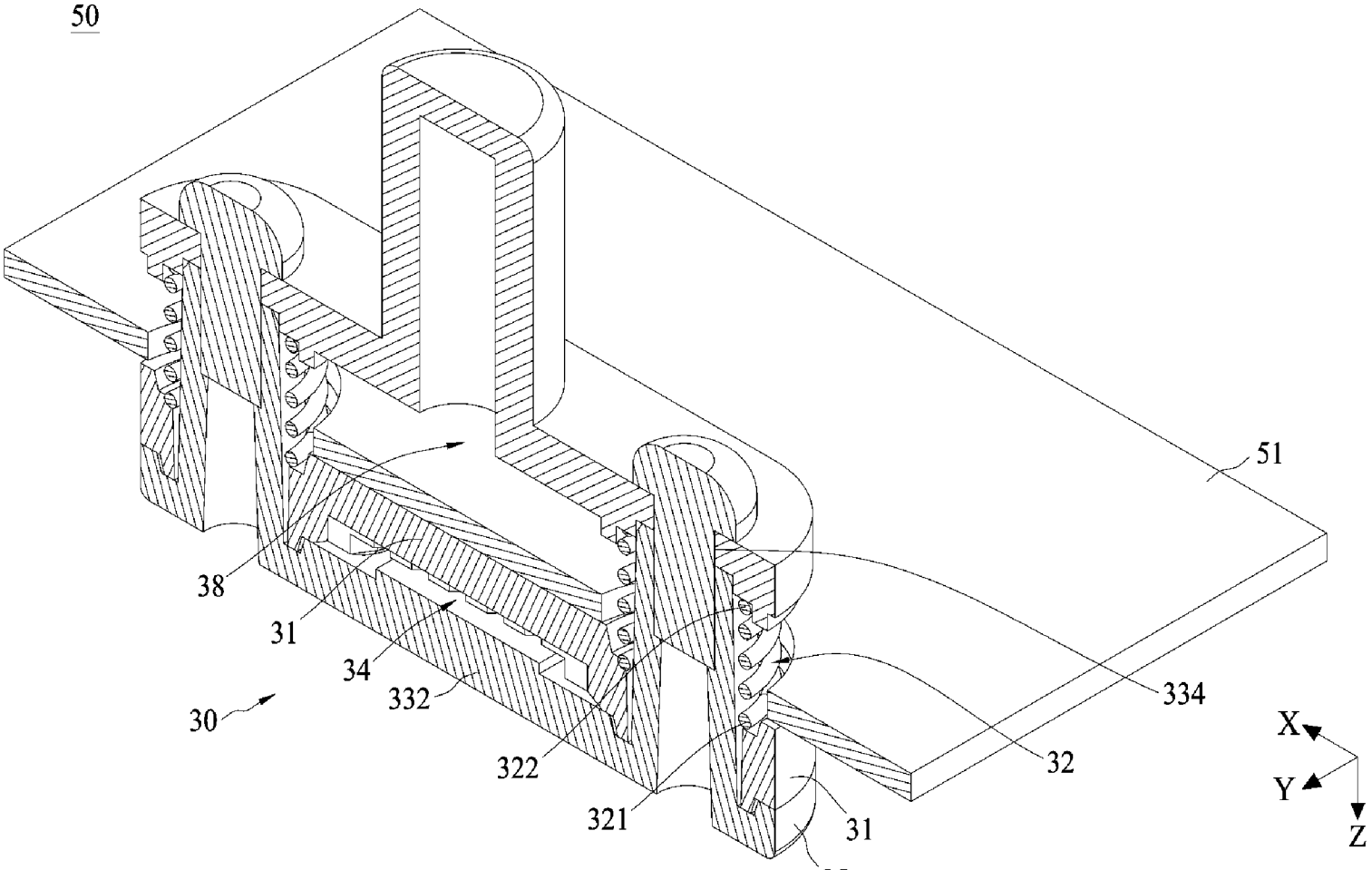
FIG. 5 is a cross-sectional view showing a holding device before being pressed according to an embodiment of the present invention.

The holding device 30 is disposed in the sensing apparatus, which is a sensor for sensing ex vitro electrochemical reaction. Such a sensor is known as an ex vitro diagnosis device or a portable POCT device. FIG. 5 shows an assembly 50 of a holding device and a supporting plate including the supporting plate 51 and the holding device 30 as shown in FIG. 4. Such assembly 50 is one part of the above-mentioned sensing apparatus. In the embodiment shown in FIG. 5, the supporting plate 51 is preferably, but is not limited to, a plastic circuit board or other flexible circuit board. The supporting plate 51 is connected with the top surface of the first accommodation portion 31. The connection between the supporting plate 51 the first accommodation portion 31 is selected from the group consisting of, but not limited to, engagement, screwing, tenon-mortise, soldering, adhesion, and so on. As shown in FIG. 5, a plurality of sensing terminals 42 of the assembly 50 are disposed in the first accommodation portion 31 in relation to the base 332 for sensing the electrochemical reaction of the testing strip (not shown) in the space 34. Since these sensing terminals 42 electrically connect with the plastic circuit board, PCB 51, the signal of the electrochemical reaction can be transmitted to PCB 51. More particularly, when the testing strip (not shown) is inserted into the space 34, the sensing terminal 42 is pressed to induce an initial signal transmitted to the circuit system (not shown) of the sensing apparatus. A plurality of the sensing terminals 42 are respectively coupled with a plurality of electrodes (not shown) as disclosed in the specification of Taiwanese Patent No. M334326.

FIG. 5 shows that the second end 322 of the elastic portion 32 contacts or connects to the outline of the aperture 334. In another embodiment shown in FIG. 6, since the fixing part 335' in the holding device 30' and the button 333' are integrated, the second end 322 of the elastic portion 32 can contact the outline of the fixing part 335'. In another embodiment, the second end 322 of the elastic portion 32 can apply force to the outline of the aperture 334 and the fixing part 335'.

Figure 6:
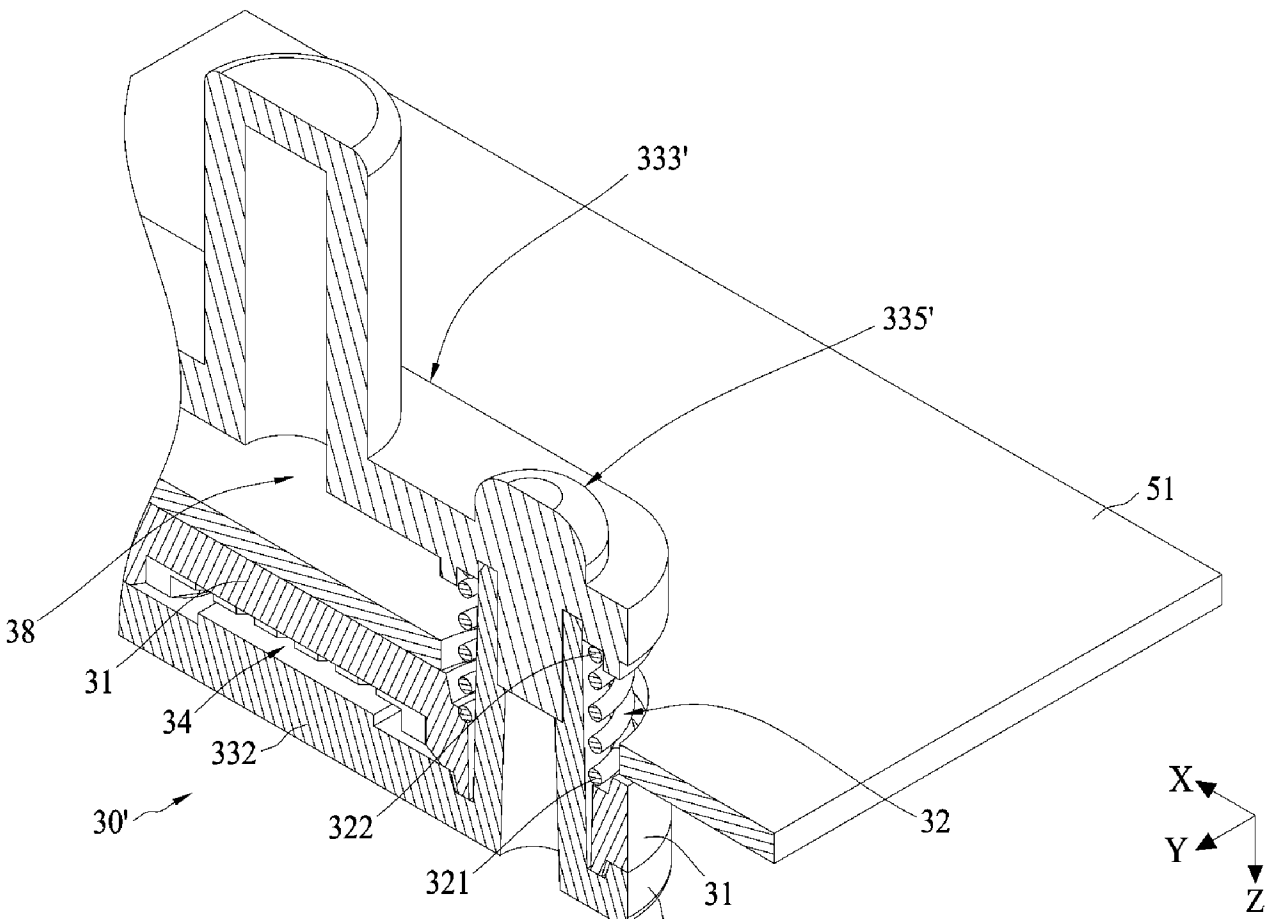
FIG. 6 is a cross-sectional view showing a holding device before being pressed according to another embodiment of the present invention.
Figure 7:
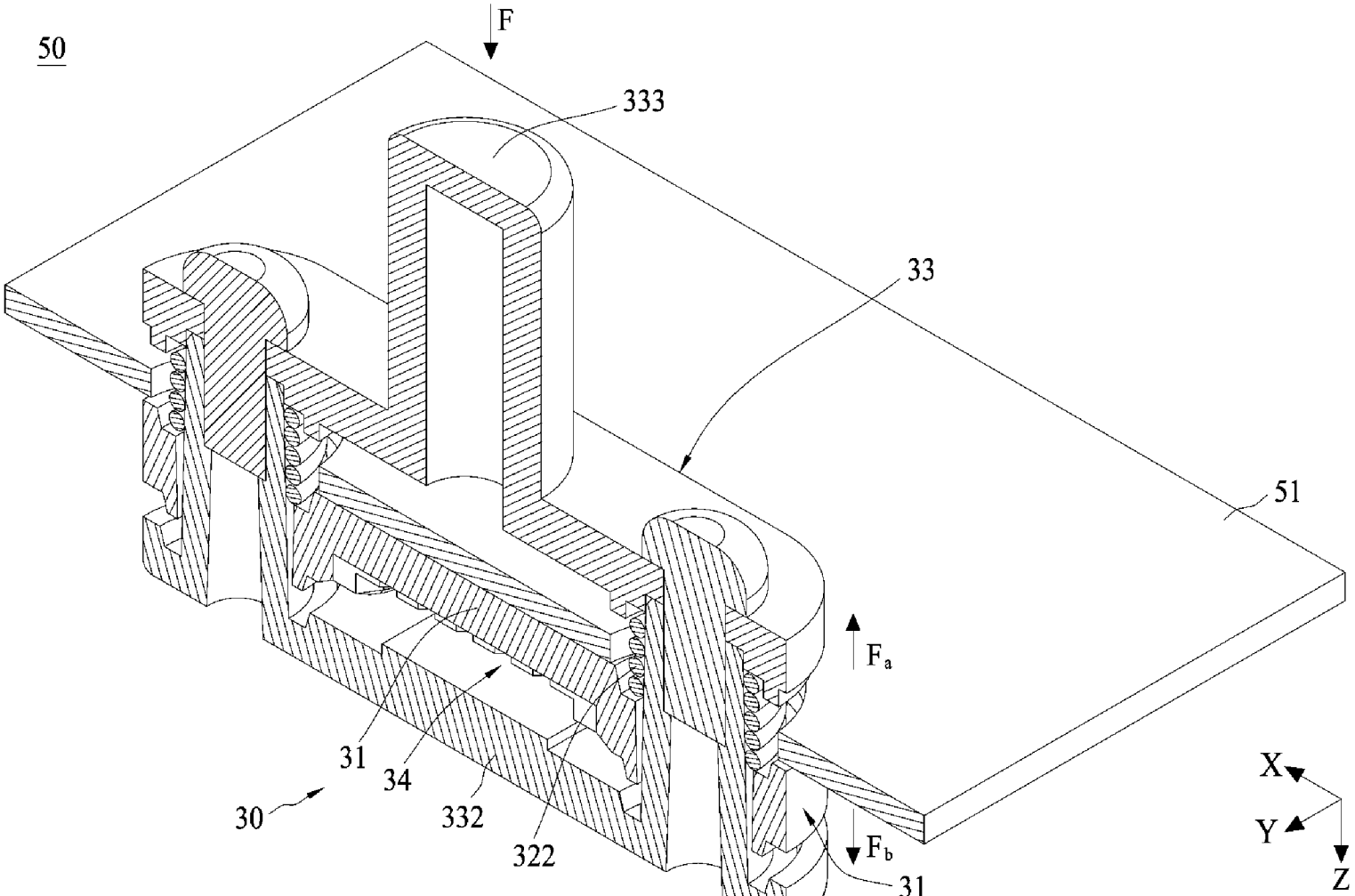
FIG. 7 is a cross-sectional view showing a holding device after being pressed according to an embodiment of the present invention.

In the embodiment shown in FIG. 7, since the elastic portion 32 contacts or connects to the actuating portion 33 and the first accommodation portion 31, without extra force F, two forces $F_a$, $F_b$ are applied to two ends 322, 321 of the elastic portion 32 to enforce the holding device 30 to remain in the position as shown in FIG. 5. In another embodiment (not shown), since the button 333 is exposed out of the housing of the sensing apparatus, the extra force F is directly applied, through button 333, to the actuating portion 33 to press the actuating portion 33 and the second accommodation portion 35 down together such that the space 34 expands in the Z-axis direction for inserting or ejecting the testing strip. However, the sensing apparatus could include other mechanisms to press the button 333 to move down the actuating portion 33 in the Z-axis direction. In other words, FIG. 5 and FIG. 6 shows that the two forces $F_a$, $F_b$ of the elastic portion 32 cause the base 332 and the first accommodation portion 31 to remain in contact to form a minimized space 34 to clip the testing strip, while another space 38 is formed under the supporting plate 51. As shown in FIG. 7, when an extra force F is applied to the button 333 to press the elastic portion 32, the space 38 is compressed so as to move the base 332 down in the Z-axis direction and expand the space 34 for ejecting the testing strip (not shown).

Although the present invention and its benefits have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present invention is not intended to be limited to the particular embodiments of the apparatus, machine, device, composition of matter, means, structure and steps described in the specification. As one of ordinary skill in the art will readily appreciate from the present invention, apparatuses, machines, devices, compositions of matter, means, structures, or steps, presently existing or later to be developed, that perform substantially the same function or achieve substantially the same result as the corresponding embodiments described herein may be utilized according to the present invention. Accordingly, the appended claims are intended to include within their scope such apparatuses, machines, device, compositions of matter, means, structures, or steps.

What is claimed is:

1. A holding device for an apparatus, the holding device comprising:

a first accommodation portion, including at least one aperture;

an elastic portion, including a first end and a second end, the first end contacting the first accommodation portion;

an actuating portion, contacting the second end; and a second accommodation portion, including at least one connecting part, passing through the aperture and connecting with the actuating portion;

wherein when the actuating portion is pressed toward the first accommodation portion, a space between the first accommodation portion and the second accommodation portion expands.

2. The holding device of claim 1, wherein the second accommodation portion further includes a base, and the connecting part is disposed on the base.

3. The holding device of claim 2, wherein the actuating portion includes a button, and when the button is pressed, the space expands; when the button is relieved, the space is reduced.

4. The holding device of claim 3, wherein an outline of the aperture forms a depressed surface, the first end contacts the depressed surface, and the elastic portion surrounds the connecting part.

5. The holding device of claim 4, wherein the actuating portion further includes a hole and a fixing part, and the fixing part penetrates the hole and connects the actuating portion and the connecting part.

6. The holding device of claim 5, wherein the second end contacts the outline of the aperture.

7. The holding device of claim 5, wherein the second accommodation portion further includes a supporting platform and at least one guiding part, the supporting platform and the guiding part are disposed on the base, and the guiding part is laterally disposed on the platform.

8. The holding device of claim 1, wherein when the actuating portion is pressed toward the first accommodation portion, the elastic portion is compressed.

9. The holding device of claim 1, wherein the actuating portion integrates with the second accommodation portion.

10. A holding device for an apparatus, the holding device comprising:

a first accommodation portion, including at least one aperture;

a second accommodation portion, including at least one connecting part, passing through the aperture;

an actuating portion, connecting with the connecting part; and an elastic portion, including a first end and a second end, wherein the first end applies force to the first accommodation portion, and the second end applies force to the actuating portion;

wherein when the actuating portion is located at an initial position, the elastic portion forces the first accommodation portion to contact the second accommodation portion, with a space therebetween.

11. The holding device of claim 10, wherein the second accommodation portion further includes a base, and the connecting part is disposed on the base.

12. The holding device of claim 11, wherein the actuating portion includes a button, and when the button is pressed, the space expands; when the button is relieved, the space is reduced.

13. The holding device of claim 12, wherein an outline of the aperture forms a depressed surface, the first end applies force to the depressed surface, and the elastic portion surrounds the connecting part.

14. The holding device of claim 13, wherein the actuating portion further includes a hole and a fixing part, and the fixing part penetrates the hole and connects the actuating portion and the connecting part.

15. The holding device of claim 14, wherein the second end applies force to the outline of the aperture.

16. The holding device of claim 14, wherein the second accommodation portion further includes a supporting platform and at least one guiding part, the supporting platform and the guiding part are disposed on the base, and the guiding part is laterally disposed on the platform.

17. The holding device of claim 10, wherein an end of the connecting part passes through the aperture, and the actuating portion connects with the end of the connecting part.

18. The holding device of claim 10, wherein the actuating portion integrates with the second accommodation portion.

* * * * *